US010648722B2

(12) United States Patent
Smith

(10) Patent No.: US 10,648,722 B2
(45) Date of Patent: May 12, 2020

(54) MODULAR CONTAINER SYSTEM

(71) Applicant: APEX COOLERS, LLC, Dallas, TX (US)

(72) Inventor: Craig A. Smith, Argyle, TX (US)

(73) Assignee: Apex Coolers, LLC, Dallas, TX (US)

( * ) Notice: Subject to any disclaimer, the term of this patent is extended or adjusted under 35 U.S.C. 154(b) by 0 days.

(21) Appl. No.: 16/119,304

(22) Filed: Aug. 31, 2018

(65) Prior Publication Data

US 2018/0372391 A1 Dec. 27, 2018

Related U.S. Application Data

(63) Continuation of application No. 15/357,654, filed on Nov. 21, 2016, now Pat. No. 10,066,863, which is a (Continued)

(51) Int. Cl.

| | |
|---|---|
| ***F25D 3/06*** | (2006.01) |
| ***F25D 31/00*** | (2006.01) |
| ***F25D 3/08*** | (2006.01) |
| ***B65D 25/32*** | (2006.01) |
| ***B65D 43/16*** | (2006.01) |
| ***B65D 81/38*** | (2006.01) |
| ***F25D 23/02*** | (2006.01) |

(52) U.S. Cl.

CPC ..... *F25D 3/06* (2013.01); *B65D 25/32* (2013.01); *B65D 43/164* (2013.01); *B65D 81/3813* (2013.01); *F25D 3/08* (2013.01); *F25D 23/026* (2013.01); *F25D 23/028* (2013.01); *F25D 31/00* (2013.01); *F25D 2331/804* (2013.01); *F25D 2400/14* (2013.01); *F25D 2400/16* (2013.01); *F25D 2400/38* (2013.01); *Y10T 29/49359* (2015.01)

(58) Field of Classification Search

CPC ..... B65D 21/0204; B65D 21/0201; B65D 25/32; B65D 43/164; B65D 43/163; B65D 43/16; F25D 3/08; F25D 3/06; F25D 31/00; A45C 11/20

USPC ..... 220/23.89, 23.4, 23.2, 23.83, 915.2, 220/915.1, 592.03, 592.02, 4.27, 4.26, 220/754; 62/457.7, 457.1; 190/18 A; 280/47.26, 47.24; 16/18 R; 446/127, 446/125, 124

See application file for complete search history.

(56) References Cited

U.S. PATENT DOCUMENTS 3,194,426 A * 7/1965 Brown, Jr. ..... B65D 21/0204 220/23.4

5,381,916 A * 1/1995 Strawder ..... B65D 21/0202 220/212

(Continued)

*Primary Examiner* — Robert J Hicks

(74) *Attorney, Agent, or Firm* — Bell Nunnally & Martin LLP

(57) ABSTRACT

An exemplary modular container system is provided that includes couplings that may, in one embodiment, be implemented as integrated or interfaced receptacles and corresponding inserts that allow accessory items to couple with a compartment, which may be referred to as a "wet box", and used as a container that holds items. The accessories may include, for example, a second compartment or "dry box" for holding items that need to be kept dry, a fishing rod holder, a shelf, a cutting board, a cup holder, a chair or seating platform, one or more dollies, or virtually any needed accessory.

19 Claims, 11 Drawing Sheets

Related U.S. Application Data continuation of application No. 14/589,899, filed on Jan. 5, 2015, now Pat. No. 9,500,400, which is a continuation of application No. 13/940,847, filed on Jul. 12, 2013, now Pat. No. 8,925,752.

(60) Provisional application No. 61/793,750, filed on Mar. 15, 2013, provisional application No. 61/671,411, filed on Jul. 13, 2012.

(56) References Cited

U.S. PATENT DOCUMENTS

| | | | | |
|---|---|---|---|---|
| 5,638,974 | A * | 6/1997 | Mann | B65D 81/361<br>220/23.4 |
| 5,890,613 | A * | 4/1999 | Williams | A45C 7/0045<br>220/23.4 |
| 2013/0213927 | A1 * | 8/2013 | Hendrickson | B65D 23/00<br>215/383 |

* cited by examiner

MODULAR CONTAINER SYSTEM

PRIORITY CLAIM

This application is a continuation of U.S. patent application Ser. No. 15/357,654 (now U.S. Pat. No. 10,066,863), filed Nov. 21, 2016 and entitled "Modular Cooler System," which is a continuation of U.S. patent application Ser. No. 14/589,899 (now U.S. Pat. No. 9,500,400), filed Jan. 5, 2015 and entitled "Modular Cooler System," which is a continuation of U.S. patent application Ser. No. 13/940,847 (now U.S. Pat. No. 8,925,752), filed Jul. 12, 2013 and entitled "Modular Cooler System," which claims the benefit of U.S. Provisional Patent Application Nos. 61/671,411, filed Jul. 13, 2012 and entitled "Modular Cooler System," and 61/793,750, filed Mar. 15, 2013 and entitled "Modular Cooler System," the disclosures of all of which are hereby incorporated by reference for all purposes.

TECHNICAL FIELD

The present invention relates generally to the field of storage containers and more particularly, but not by way of limitation, to a modular container system.

BACKGROUND

Thermal containers, which may be referred to as coolers, ice chests, ice boxes, insulated containers, and the like, are used for a number of applications and in a variety of environments. In one application, a thermal or insulated container or cooler may be used to carry food, perishables, drinks, such as canned drinks or bottled water, and will often include ice or some other cooling agent to maintain the items at a desired temperature range. In other applications, food or other cargo susceptible to spoiling may be carried in a cooler to maintain such items at a desired temperature in either a wet or dry environment. Problems may arise when items that need to be maintained at or below a particular temperature are used in an application in which the lid or entry point to a thermal cooler is frequently opened, thus making temperature regulation and maintenance difficult.

Because of the numerous and varied applications and uses of a cooler, they come in multiple sizes for a variety of uses. Consumers often have to purchase numerous different coolers of the same and different sizes based upon the various applications and uses. In certain applications, a user may desire to have a cooler with a wet area, such as when ice is used, and a cooler with a dry compartment in which ice or water is not desired. In still other applications, such as when fishing, you may need a cooler to hold recently caught fish or prepared fish and another cooler to carry food for immediate consumption, and another for live fishing bait.

As demonstrated, these varied uses are often not compatible, or desirable, with one another. Additionally, thermal containers are often heavy (especially when loaded with ice and/or cargo) and/or difficult to transport, provided in various sizes and shapes that are often not compatible with one another, and cannot be easily secured while transporting or while in use. Most coolers are not expandable in any meaningful manner, and are lacking in any additional functionality.

SUMMARY

In accordance with the present invention, a modular container system is provided that substantially eliminates one or more of the disadvantages and problems outlined above.

According to an exemplary aspect of an embodiment of the present invention, a modular container system is provided that can be transported and secured while being used.

According to another exemplary aspect of an embodiment the present invention, a modular container system is provided that provides expandable capacity, and increased functionality, including in certain embodiments, one or more of the following accessories and capabilities: a fishing rod holder, a drink or cup holder, a sitting area, both dry and wet insulated compartments, one or more dollies, a cutting board, a locking lid, a shelf, a radiant barrier layer on or within the lid or one or more walls of the container, and the capability to connect one or more wet or dry boxes together.

Other technical advantages may be readily apparent to one skilled in the art after review of the following figures and description associated herewith.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION

It should be understood at the outset that although exemplary implementations of the present invention are described below, the present invention may be implemented using any number of techniques, whether currently known or in existence. The present invention should in no way be limited to the exemplary implementations, drawings, and techniques illustrated below, including the exemplary design and implementation illustrated and described herein. Additionally, the drawings contained herein are not necessarily drawn to scale.

Figure 1:
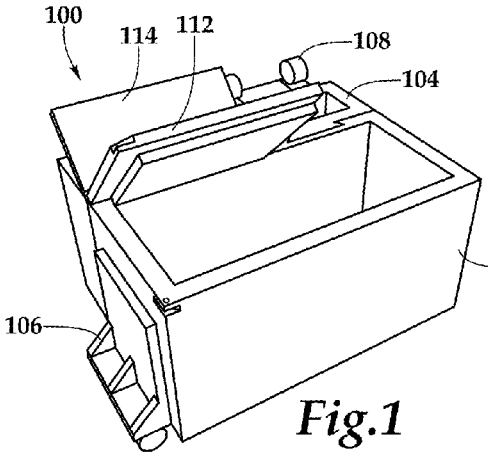
FIG. 1 is a top, front, left-side perspective view of one configuration of a modular container system.

FIG. 1 is a top, front, left-side perspective view of one configuration of a modular cooler system 100. The modular cooler system 100 includes a wet box 102 with an open top end, which also may be referred to as a first insulated compartment or box, with a dry box 104 coupled or attached to a back portion of the wet box 102. Further, a dolly 106 is shown coupled or attached to the wet box 102 on a first side, which may be referred to as a left side in this view so that the modular cooler system 100 may be elevated on an opposing side and transported using the rollers or wheels of the dolly 106 also referred to as a wheeled-dolly 106.

The wet box 102 includes an insulated lid or cover 112, which is shown in FIG. 1 not extending entirely over the opening. This is done purely for illustrative purposes, and preferably the lid or top cover portion 112 will extend to cover the entire opening of the internal volume within the wet box 102. The wet box 102 may serve as a cooler, thermal container, or insulated container that, generally, will contain ice or other cooling element to keep food or other perishables chilled or at or below a desired temperature.

The wet box 102 may be defined by the combination or arrangement of a front portion or a front side, a back portion or a back side, a right and left side, a bottom, and the lid or top cover portion 112. In one embodiment the top cover portion or lid 112, when closed, may be secured through a pad lock or a locking device that ensures that the lid 112 is secured at the top corner of the front and left side of the wet box 102.

The internal volume of the wet box 102 will, in certain embodiments, include a drain opening or plug that, in a preferred embodiment, will be provided on a lower portion, such as the lower end of a slightly angled floor of the bottom of the internal volume, so that water or other fluids may be conveniently drained. In one embodiment, this drain plug may include connections to allow a tube or hose or other connecting member to couple to the drain plug to provide a passageway for fluids to flow out of or into the bottom of (or lower side of) the internal volume of the wet box 102.

In a preferred embodiment, the wet box 102 includes couplings that may be implemented as either male or female members. FIG. 1 illustrates one implementation of couplings in which a female or receptacle member is provided on the left side that provides a coupling for a slideable insert that is included on the side of an accessory, such as the dolly 106, which is not visible in FIG. 1. Similarly, two external receptacles are provided on the external portion of the back wall of the wet box 102 that each extend from an opening beginning at the top portion of the back portion of the wet box 102 and extending downwardly towards the ground to a closed end. The dry box 104 includes corresponding slidable projections or inserts on a back portion such that the slidable projections couple with the corresponding receptacles of the wet box 102 to secure the dry box 104 to the back portion of the wet box 102. In alternative embodiments, more or less couplings may be used and the receptacles and projections may be reversed or mixed.

The dry box 104 is shown with a lid 114 as well as a dolly 108 stored in a receptacle along a front portion of the dry box 114. The dolly 108, as will be discussed below and in subsequent figures, may be used on the right side of the wet box 102, similar to the orientation of the dolly 106, so that the modular cooler system 100 is elevated above the ground and may be easily or conveniently rolled.

Figure 2:
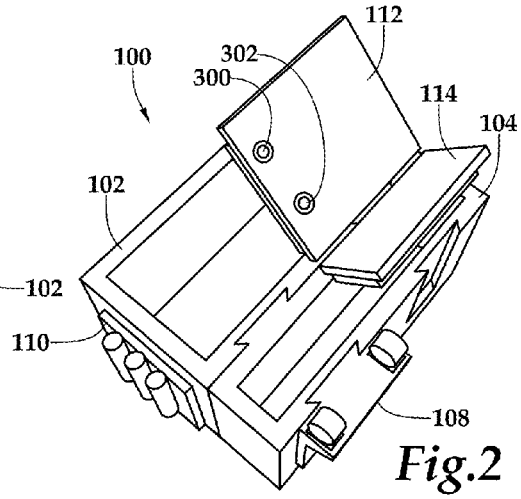
FIG. 2 is a top, back, right-side perspective view of one configuration of a modular container system.

FIG. 2 is a top, back, right-side perspective view of one configuration of the modular cooler system 100. The configuration of the modular cooler system 100 is as provided in FIG. 1, with a fishing rod holder 110 positioned along a second or a right side of the wet box 102. The rod holder 110 is shown with three tubular openings that may be used to support the handle of a fishing rod, such as when fishing from a bank, pier or boat. Of course, more or less rod holders may be implemented.

Additional detail of the coupling or connection of the dry box 104 to the wet box 102 is provided in FIG. 2 as well as the storage of the dolly 108 on the front side of the dry box 104 in a receptacle provided along an external portion of the front side of the dry box 104. Although the shape of the receptacles and slideable inserts, which are designed to frictionally engage and mate with one another, are shown with symmetrical, angled sides, in other embodiments, these couplings may be rounded, "squared" off and may not be symmetrical from one side to the other. In one embodiment, the coupling members may be tapered from the open top end downward. In still other embodiments, the receptacle, instead of being integrated into the wall, which may be implemented in one configuration as a plastic wall that has been rotary or rotationally molded (which also may be referred to as a roto-molding), the insert and receptacle may be externally attached or using other available couplings provided at such locations. These couplings may be integrated, as just discussed, or externally positioned or interfaced with the wet box 102 and the dry box 104. Similarly, the accessories, such as the rod holder 110 and the dolly 108, may include corresponding couplings and/or receptacle/insert mating junctions.

Once again, the lid 112 and the lid 114 are shown, for illustrative purposes only, as not covering the entire internal volume of their respective boxes. The lid 112 and lid 114, in a preferred embodiment, will include molded hinges with interlocking openings that are coupled through a central rod, such as an aluminum or metal rod, and with no or few screws or other fasteners. This implementation provides superior performance and endurance in many cases. In a preferred embodiment, an elastomeric or plastic gasket or seal will be provided along an edge on the underside of each lid 112 and lid 114 to provide a superior seal when the lid 112 and the lid 114 are closed. This increases the thermal efficiencies of each such boxes.

The lid 112, in certain implementations, may include moldable openings and/or indentations, such as cup holder 300 and cup holder 302 that may be used to receive and/or secure a can, glass or cup when the lid 112 is closed and parallel to the ground or surface.

In use, the wet box 102 will include ice or some cooling agent and will be used to store food, drinks, fish, or other desired perishable items that need to be maintained at a particular temperature. The dry box 104 may be used to store sandwiches, breads and other items, such as phones and the like in an environment without liquids or melting ice.

The dry box 104, in one embodiment is roto-molded and includes insulation along every wall that forms the internal volume, similar to wet box 102. In other embodiments, the dry box 104 does not include as much insulation as the wet box 102. In other embodiments, the dry box 104 is provided without any added insulation. In other embodiments the modular cooler system 100 may be manufactured using traditional metal components, such as sheet metal siding, or any available material or manufacturing technique that may provide the desired support and functionality. This also may include the use of plastic injection molding systems.

Figure 3:
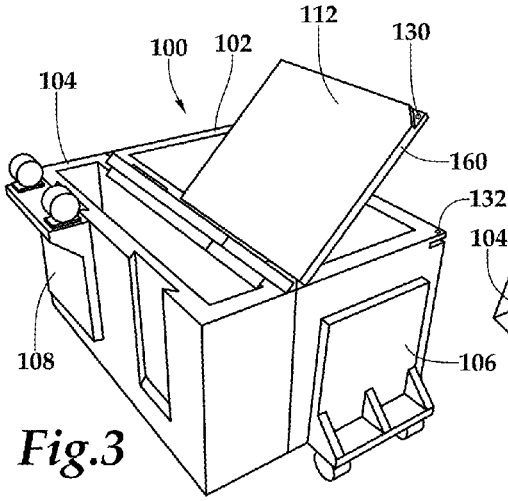
FIG. 3 is a top, back, left-side perspective view of one configuration of a modular container system.

FIG. 3 is a top, back, left-side perspective view of one configuration of a modular cooler system 100. This view of the top cover portion or lid 112 of the wet box 102 illustrates one embodiment in which a lock opening 130 at the corner of the lid 112 may adjoin a lock opening 132 when the lid 112 is closed. This opening may be used to insert a rod, lock, or other mechanism to secure the lid 112 of the wet box 102 in a closed position.

Also shown in FIG. 3 is a side edge of a radiant barrier member or layer 160. The radiant barrier layer 160 may be integrated within the lid 112 and, in a preferred embodiment, will be positioned within a slot in the lid 112 so that the radiant barrier member 160 may be slid within the slot and positioned such that the radiant barrier layer can be seen on the inside surface of the lid 112. The radiant barrier member 160 will preferably include a reflectivity rating or value greater than 60%, such that at least 60% of the thermal radiation or thermal heat is reflected. The measurement of reflectivity is known and available to one of ordinary skill in the art of radiant barrier materials and ratings. In other embodiments, a radiant barrier layer is implemented in, on or adjacent the lid 112, and one or more of the other walls or portions that make up the internal volume of the wet box 102.

Figure 4:
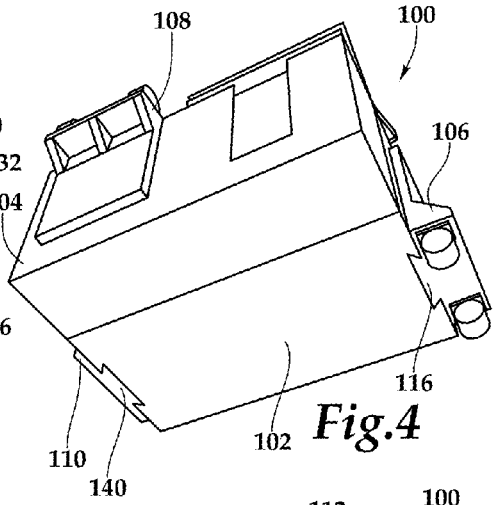
FIG. 4 is a bottom, back, left-side perspective view of one configuration of a modular container system.

FIG. 4 is a bottom, back, left-side perspective view of one configuration of the modular cooler system 100. A slidable projection or insert 116 of the dolly 106 is shown coupled with the side receptacle of the wet box 102. In operation, the one or more wheels of the dolly 106 will contact the ground or surface for rolling while the opposite side of the wet box 102 is elevated. In such a state, the modular cooler system 100 may be rolled using one or more wheels of the dolly 106, while a significant portion of the weight of the modular cooler system 100 are supported by the one or more wheels of the dolly 106.

A slideable insert 140 of the rod holder 110 is shown engaged or coupled with a side receptacle of the wet box 102. This friction fit, when in place, prevents the rod holder 110 from slipping out from a side receptacle of the wet box 102. In the event the friction fit is not sufficient when in use, the bottom surface of the slideable insert 140 will be provided on a flat surface along with the external bottom portion of the wet box 102 and the dry box 104. In this position, the ground or surface in which the modular cooler system 100 rests will prevent the slideable insert of the rod holder 110 from sliding out of the side receptacle. This provides additional security that the rod holder will be maintained in place.

In one implementation, the side receptacles of each side of the wet box 102 are provided with the same shape and/or dimensions, thus allowing any of a variety of accessories, such as those already discussed and those discussed below, to be interchangeably positioned at a desired receptacle. For example, the rod holder 110 may be positioned on the opposite side where the dolly 106 is currently shown positioned. While the dolly 106 may be positioned where the rod holder 110 is shown. When not in use, the rod holder 110, similar to the dolly 108, may be stored along an external backside receptacle of the dry box 104, such as in the open receptacle shown next to the dolly 108 of FIG. 3.

In an alternative embodiment, not shown in FIG. 4, a second wet box 102 may be provided and coupled to the dry box 104 through the two receptacles provided on the external front wall of the dry box 104 (or using a different embodiment of the dry box 104 that includes two slidable inserts in place of the two receptacles provided on the external front wall of the dry box 104, similar to the back wall of the dry box 104). In certain embodiments, receptacle converters and/or slidable insert converters may be used to connect the boxes as desired. These converters are described more fully below in connection with FIGS. 31 and 32. The dolly 108 may be removed, and a second wet box 102 may be coupled, similar to wet box 102 as shown, to the back side of the dry box 104. This provides the capability to increase overall wet box storage volume and capability as needed.

Figure 5:
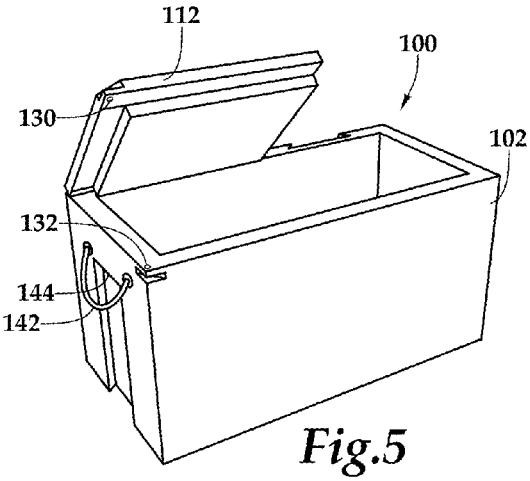
FIG. 5 is top, front, left-side perspective view of one configuration of a wet box of a modular container system.

FIG. 5 is top, front, left-side perspective view of one configuration of the wet box 102, as previously shown and discussed, of the modular cooler system 100. The wet box 102 which also may be referred to the first insulated box or first insulated compartment is shown with the partial portion of the lid 112 open and with an additional layer or ridge that may reside within the internal volume of the wet box 102 when the lid 112 is closed or shut. Along an edge surrounding this lower level or member may include a freezer-type gasket, such as a plastic or elastomeric gasket or seal. As previously discussed, a radiant barrier member or material may be provided within or adjacent to the lid 112. The radiant barrier reflects, inhibits, or prohibits the penetration of thermal radiation, and may have a reflectivity of thermal radiation rating that is greater than 60% and is preferably greater than 80% or 90%, using reflectivity measurements of radiant barrier materials, such as aluminized surfaces, metalized or embedded particles, or aluminum surfaces that reflect thermal heat or thermal radiation.

In one embodiment, a nylon or rope handle 142 is shown positioned one side of the wet box 102 above the closed end of the receptacle. Preferably, a rope handle will be provided on the opposite side of the wet box 102. The rope handle 142 may consist entirely of one material or may include a braided material with a rubber or a polymer handle to provide a more comfortable grip. In other embodiments, a molded handle is provided at the closed end of the receptacle on each side of the wet box 102. For example, a molded handle 144 may be provided at or above the closed (or partially closed) end of the receptacle as shown in FIG. 5.

One or more rubber, plastic or scratch resistant members may be provided on the bottom portion of the wet box 102 to provide a stable and safe manner in which to grip or interface with the ground or surface on which the wet box 102 resides. In one embodiment, four rubber feet are placed near or adjacent each bottom corner of the wet box 102. In other embodiments, a skid resistant member is applied or integrated into the bottom portion of the wet box 102 to provide the same or similar desired characteristics.

Figure 6:
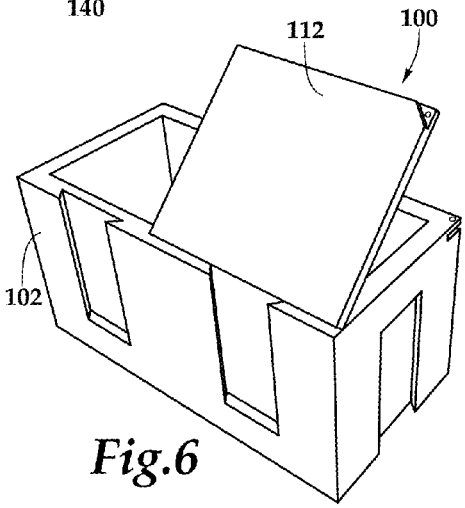
FIG. 6 is top, back, left-side perspective view of one configuration of a wet box of a modular container system.

FIG. 6 is top, back, left-side perspective view of one configuration of the wet box 102 of the modular cooler system 100, similar to FIG. 5. The two integrated open, external receptacles are shown on the back portion or back wall of the wet box 102. Rubber latches may be provided to secure the lid 112. In one embodiment, three rubber latches are provided, but it should be understood that any of a variety of known or available latches or clasps may be used. Once again, throughout the figures of the application, the lid 112 and the lid 114 are not shown extending the full length of the opening of the respective internal volumes. This is illustrative purposes only so that more features of the embodiment may be visible.

Figure 7:
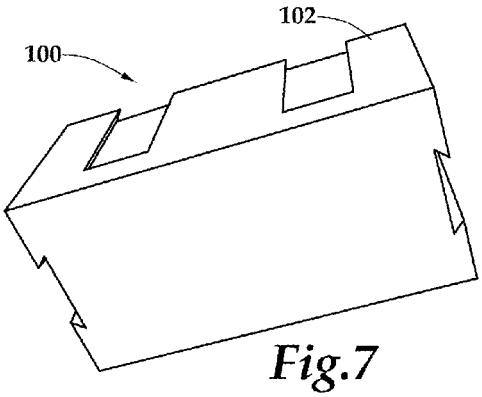
FIG. 7 is bottom, back perspective view of one configuration of a wet box of a modular container system.
Figure 8:
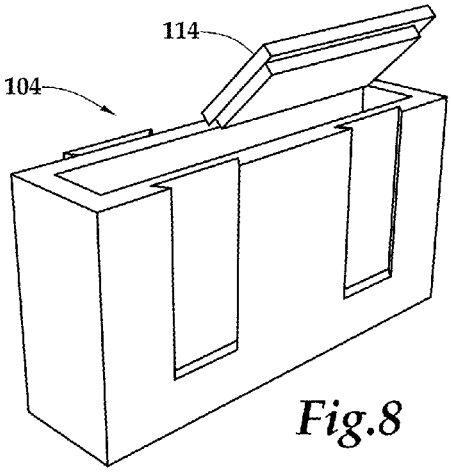
FIG. 8 is top, front, left-side perspective view of one configuration of a dry box of a modular container system.
Figure 9:
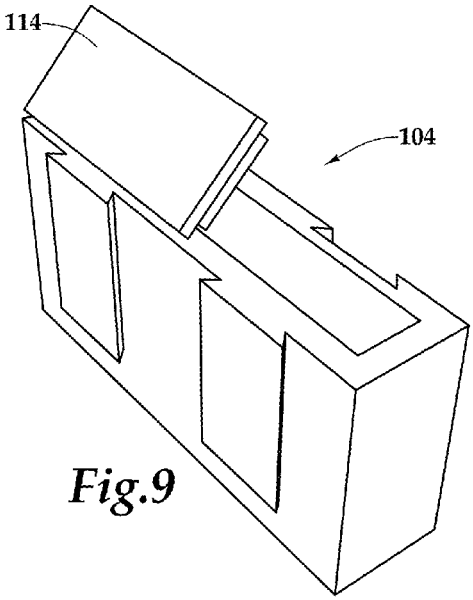
FIG. 9 is top, back, left-side perspective view of one configuration of a dry box of a modular container system.
Figure 10:
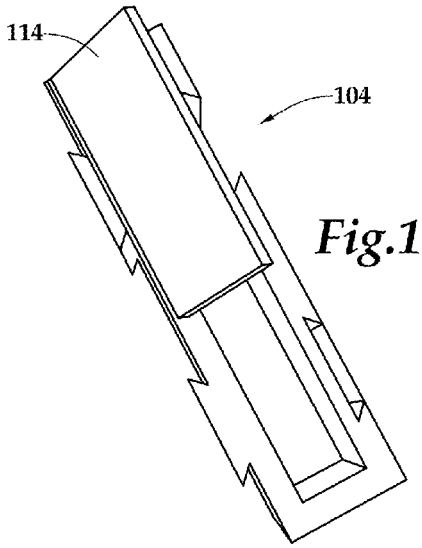
FIG. 10 is top perspective view of one configuration of a dry box of a modular container system.
Figure 11:
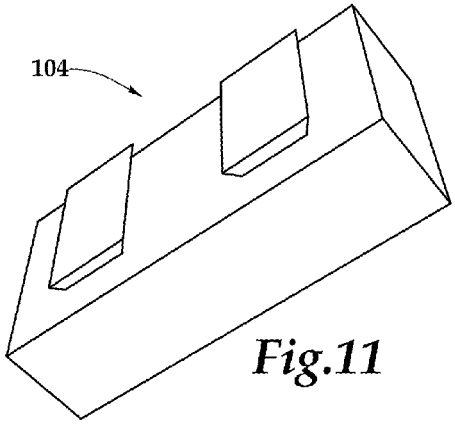
FIG. 11 is bottom, back, left-side perspective view of one configuration of a dry box of a modular container system.
Figure 12:
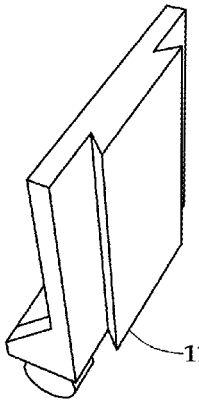
FIG. 12 is a top, back, right-side perspective view of one configuration of a dolly with slideable insert for use in a modular container system.
Figure 13:
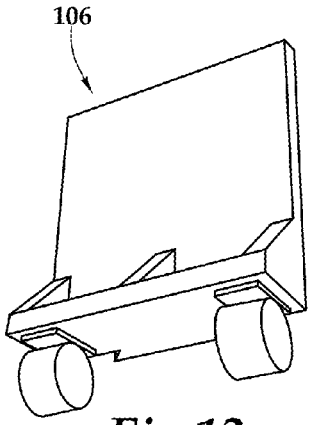
FIG. 13 is a bottom, front, right-side perspective view of one configuration of a dolly for use in a modular container system.
Figure 14:
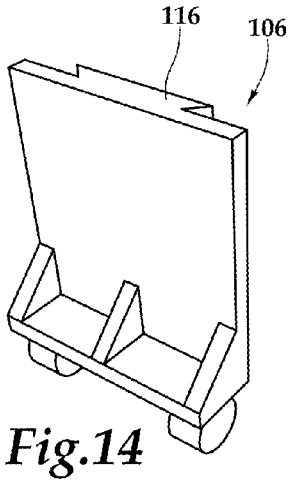
FIG. 14 is a top, front, right-side perspective view of one configuration of a dolly for use in a modular container system.
Figure 15:
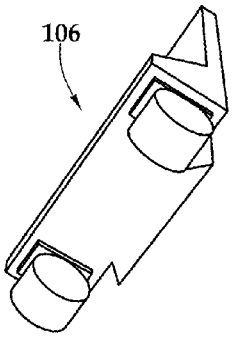
FIG. 15 is a bottom, right-side perspective view of one configuration of a dolly for use in a modular container system.

FIG. 7 is a bottom, back perspective view of the wet box 102 of the modular cooler system 100. The open, bottom end of the receptacles on each end of the wet box 102 are shown as well as the back two receptacles with open ends at the top portion that may be used to receive a slideable projection or insert from an accessory, such as the dry box 104 or rod holder 110. It should be understood, that one or more receptacles may be provided in other implementations, and that in other implementations these receptacles may be integrated or coupled to the sides of the wet box 102. In still other embodiments, slideable inserts or male couplings may be provided on the wet box 102.

It should be understood that the slidable receptacles or slidable projections or inserts illustrated throughout the drawings and described herein may be reversed from one another in actual implementations. For example, a receptacle positioned or accessible through an external surface or portion of a first compartment that couples or mates with a projection positioned or accessible through an external surface or portion of a second compartment (or accessory) may be implemented in a reverse configuration where the projection is provided at the first box and the receptacle is provided at the second box (or accessory). These coupling members may also be referred to as an external projection and an external receptacle, and, in some embodiments, may be referred to as an accessory projection and an accessory receptacle. Generally, these coupling members may be slidably engaged, or in slidable engagement, with one another, and this may include, for example, a frictional, gravitational, or mechanical coupling.

Further, it should be understood that the slidable receptacles and slidable projections or inserts as shown and described herein are examples of any of a variety of couplings. These couplings may be implemented using any known or available coupling positioned on, in, or adjacent a portion of a compartment or accessory, and used to join or couple two compartments or a compartment and an accessory to one another. For example, such a slidable coupling may couple items together using any known or available mechanical linkage, friction fit, and/or magnetic coupling, which is now or later known or available to one of ordinary skill in the art. This may involve male/female type couplings, or non-male/female type couplings.

In still another alternative embodiment, a receptacle or slidable insert may be provided on the external bottom portion of the wet box 102. A corresponding coupling may be mounted to a surface such that the wet box may be slid or attached to such coupling to secure the wet box to the surface. This may occur, in a boat, trailer, pier, house, or a moving vehicle to ensure that the wet box 102 is secure.

FIGS. 8-11 show various views of the dry box 104. The illustrated embodiment shows two receptacles positioned on the front side of the dry box 104 with two slideable projections positioned on the back side of the dry box 104. In other embodiments, slideable projections are provided in place of the two receptacles. In still other embodiments, receptacles are provided in place of the slideable projections.

As previously discussed, the dry box 104 may be roto-molded, injection molded, or formed from a plastic, polymer, or other suitable material, for example polyethylene. In a preferred embodiment, the dry box 104 will be provided as an insulated compartment that is roto-molded and includes insulation within the internal portions of the walls of the dry box 104. For example, the wet box 102 and the dry box 104 may be rotationally molded using a rotational molding machine. The boxes 102, 104 may be molded as a single hollow part having an inner wall and an outer wall spaced apart to define the hollow part. After molding, holes may be cut from a bottom surface of the external wall to allow the space between the inner and outer walls to be filled with an insulator, such as a foam or other suitable polymeric insulation. In one embodiment, high density polyurethane is used as the insulation material. In certain embodiments, the holes that are cut for the foam filling may also receive attachment of the anti-skid pads 829 (see FIG. 35B).

The lid 114 of dry box 104, similar to the lid 112 of the wet box 102, may be insulated and will include, in a preferred embodiment, a hinged connection that includes molded projections defining through holes that align and interconnect with one another and are hingably coupled together through the use of a rod or cylindrical member such that the number of screws or fasteners are minimized and performance is increased. In other embodiments, plastic hinges may be used or any available hinges suitable for a particular implementation of the modular cooler system 100 may be utilized.

In one embodiment, the outer or upper surface of the lid 112 or the lid 114 may include a cutting board portion or area in which meat or fish may be filleted or prepared. In other embodiments, a cushion or seating member may be provided or attached to the upper portion of the lid 112 and/or the lid 114. In still other embodiments, a cup holder may be integrated or molded into the lid 112 and/or the lid 114. In still another embodiment, a corrugated or skid resistant surface may be provided on the top surface of the lid 112 and/or the lid 114.

FIGS. 12-15 are various views of a dolly, such as the dolly 106 and the dolly 108, that are implemented as accessories to the modular cooler system 100. The dolly 106 of FIG. 12 includes two rollable wheels, but in other embodiments may include one or more rollable members, such as castors, bearings, or other slideable elements. A slideable insert 116 may be implemented on an opposing side of the dolly 106 to mate with one or more receptacles or openings of the wet box 102 or another accessory, such as the dry box 104. In other embodiments, the slideable insert 116 may itself be implemented as a receptacle so that the dolly 106 may couple or connect with a corresponding slideable insert that may be provided on a side wall of the wet box 102 and/or the dry box 104 or elsewhere. These figures of the dolly 106 illustrate support ribs or members that may be used to provide mechanical or structural support to the dolly 106.

Figure 16:
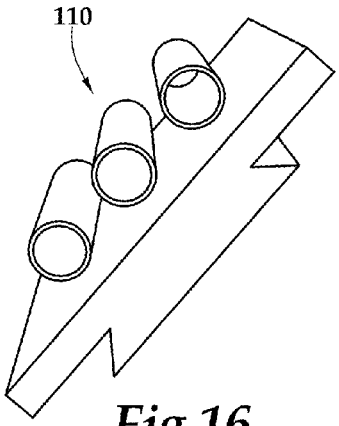
FIG. 16 is a bottom, front perspective view of one configuration of a rod holder for use in a modular container system.
Figure 17:
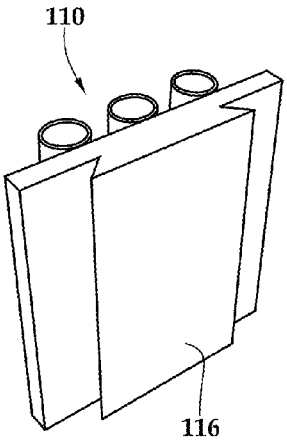
FIG. 17 is a top, back, right-side perspective view of one configuration of a rod holder for use in a modular container system.

FIGS. 16-17 include various views of the rod holder 110 that may serve as an accessory to the modular cooler system 100. Just as with the dolly 106, the rod holder 110 may be implemented with a coupling on the opposing side such as a slideable insert as shown. In other embodiments, a receptacle may be provided in place of the slideable insert shown in the figures.

Figure 18:
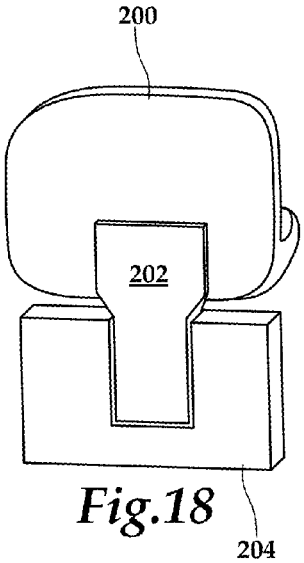
FIG. 18 is a back view of one configuration of a chair or seating platform attached as part of a modular container system.
Figure 19:
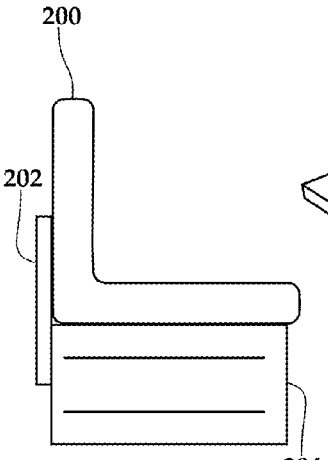
FIG. 19 is a side view of a chair or seating platform of FIG. 18 shown positioned above a wet box or a dry box.

FIGS. 18-19 include various views of a seat accessory 200 that includes a slideable insert 202 and as shown coupled to an item 204. The item 204 may be any of a variety of accessories, or boxes, such as the wet box 102 and the dry box 104. In this embodiment, the seat accessory 200 includes a back portion and a seat portion. In alternative embodiments not shown, the seat accessory 200 may only include a back portion 200 while the seat portion may be eliminated as the top surface of a box, such as the wet box 102, may serve as the seat portion.

Figure 20:
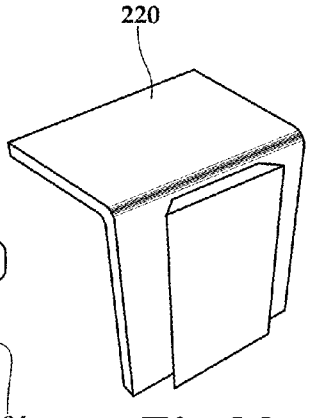
FIG. 20 is a perspective view of one configuration of a shelf to be attached and used as part of a modular container system.
Figure 21:
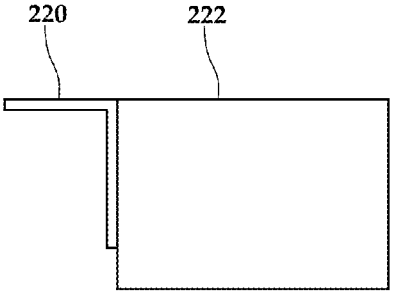
FIG. 21 is a side view of the shelf of FIG. 20 shown attached to the side of a wet box or a dry box.

FIGS. 20-21 include a perspective view of a shelf accessory 220 as well as a view of the shelf accessory 220 installed and coupled with an item 222. The item 222 may be any other accessory or box, such as the wet box 102. This embodiment of the shelf accessory 220 utilizes a slideable insert on a back portion to couple with a corresponding receptacle that is open at the top portion and receives the slideable insert. In other embodiments, the slideable insert and receptacle portions are reversed. In still other embodiments, other coupling or mating portions are provided.

Figure 22:
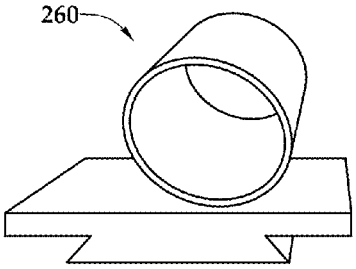
FIG. 22 is top, front perspective view of one configuration of a cup holder for use in a modular container system.

FIG. 22 is a top view of a cup accessory 260 that may be used with the wet box 102 or other accessory. This implementation of the cup accessory 260 is shown with a slideable insert. Of course, as discussed with other accessories, the slideable insert may be replaced in certain embodiments with a receptacle for receiving a slideable insert.

Figure 23:
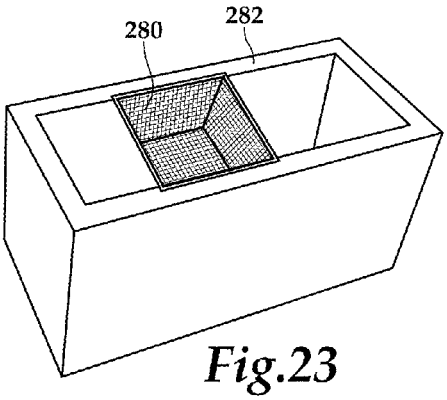
FIG. 23 is a strainer basket used in a wet box of a modular container system and supported along a first and second rim.

FIG. 23 is a perspective view of a strainer basket accessory 280 shown positioned within the internal volume of an item 282, such as the wet box 102. In this embodiment, the strainer basket accessory 280 has a first and a second longitudinal edge that rest upon an upper top ledge of the item 282. In other embodiments, the strainer basket accessory 280 is provided to fill, or be positioned within the vast majority of, the internal volume of the item 282. In operation, in one embodiment, fish or other individual items may be provided or placed into the basket 280 while ice may be provided at the bottom or around the internal volume of the item 282.

A lid, not shown in FIG. 23, may be closed so that the fish or other individual items may be kept cold. At such time when it is desirable to remove the fish or items that are provided within the strainer basket accessory 280, the entire strainer basket accessory 280 may be lifted out of the internal volume of item 282 and conveniently and easily moved to a desired location without individual handling of each individual fish or item provided therein.

Figure 24:
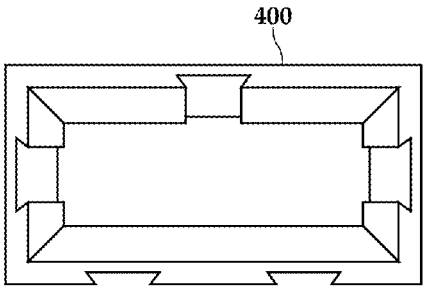
FIG. 24 is a top view of an alternative configuration of a wet box showing receptacles provided within the wet box.
Figure 25:
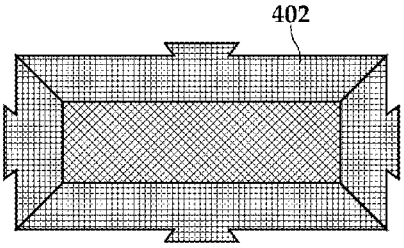
FIG. 25 is a top view of a strainer basket for use with the wet box of FIG. 24 of a modular container system.

FIGS. 24 and 25 illustrate additional aspects of the modular cooler system 100 that may be implemented in certain embodiments. FIG. 24 provides a top view of a wet box 400, which is shown without a lid that includes two external receptacles with openings at the top on a front wall of the wet box 400 while also providing three internal receptacles placed on two internal side walls and back wall of the internal volume of the wet box 400. These receptacles also extend to a top portion.

The strainer basket accessory 402 is shown with corresponding slideable inserts or wire configurations that mate with the internal receptacles of the internal volume of the wet box 400 when placed within the internal volume. Thus, the strainer basket accessory 402 may be placed securely within the internal volume of the wet box 400.

The strainer basket accessory 402 may be made of metal, plastic, or some available or desirable material that allows water or other fluids to at least partially drain through the strainer basket accessory 402 as it is put out of the internal volume of the wet box 400.

The various internal receptacles of the internal volume of the wet box 400 may also be used to receive slidable inserts of accessories, such as, for example, the dolly 106, the rod holder 110, or a cup holder, so that such accessories may be conveniently stored within the internal volume of the wet box 400 when it is not in use or during transit.

Figure 26:
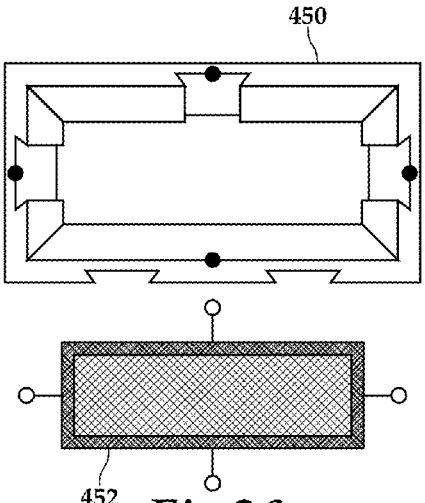
FIG. 26 is a top view of a wet box along with a strainer member that may be positioned within the wet box and attached at one or more locations.

FIG. 26 is another implementation of a strainer basket accessory. A wet box 450, which is shown without a lid, may be provided with two external receptacles that are open at the top and provided on an external front wall of the wet box 450. A strainer basket accessory 452 is shown in FIG. 26 from a top view with four attachment members or rings that may be placed around each of the corresponding members shown on the four sides of the wet box 450.

Figure 27:
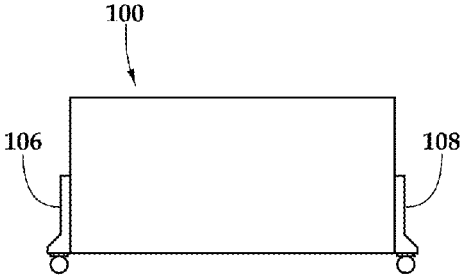
FIG. 27 is a side view of a modular container system with a dolly attachment on the left and right side so that the modular container system may be rolled without lifting.
Figure 28:
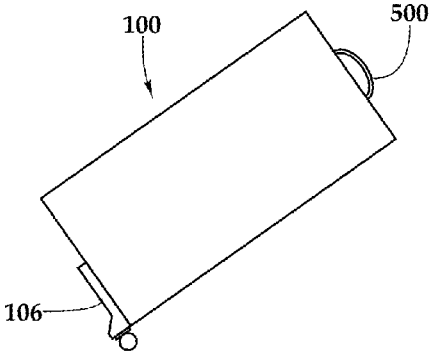
FIG. 28 is a side view of a modular container system having a dolly on one side so that the system may be rolled by elevating the side opposite where the dolly is positioned.

FIGS. 27 and 28 include illustrations of different configurations or placements of the dolly 106 and dolly 108 in relation to the modular cooler system 100. Although the modular cooler system 100 is shown in FIG. 27 and FIG. 28, this may include only the wet box 102 and/or a combination of the wet box 102 and various other accessories, such as the dry box 104.

Referring to FIG. 27, the dolly 106 may be mated or coupled, preferably through a slideable insert and receptacle coupling on the left side of the modular cooler system 100 while the dolly 108 is coupled on the opposite side. As is shown, this configuration of the dollies lifts the bottom portion of the modular cooler system 100 above the ground or surface. This makes transportation or movement of the modular cooler system 100 easy and involves simply pushing or rolling the modular cooler system 100 along the ground.

FIG. 28 is a side view of the modular cooler system 100 shown angled or lifted on the right side with the dolly 106 positioned in place on the left side (and without the dolly 108 positioned below the opposing side as was illustrated in FIG. 27). A handle, such as a rope handle 500 is provided along the side opposite of where the dolly 106 is positioned. Upon elevation of one side of the modular cooler system 100 using, preferably, the handle 500 or an integrated or molded handle not shown, a user may then roll the modular cooler system 100 using the one or more wheels of the dolly 106. This provides yet another convenient method of transporting or moving the modular cooler system 100, which may be quite heavy when loaded with ice and/or other items.

Figure 29:
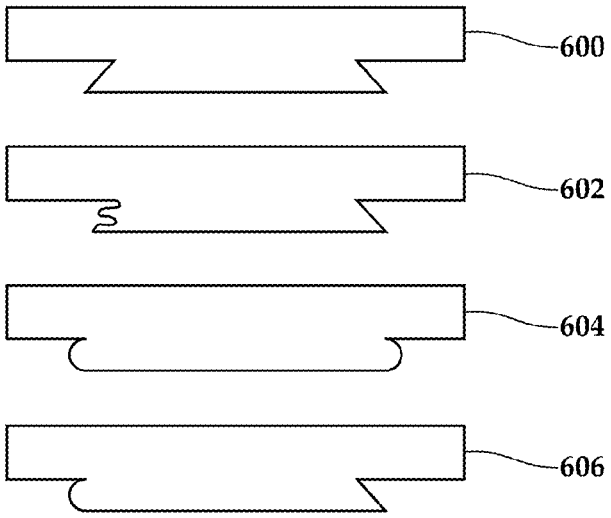
FIG. 29 is a series of end views of various configurations of slidable inserts that may be used in the modular container system, and which demonstrate both symmetrical and non-symmetrical inserts.

FIG. 29 is a series of end views of various configurations of slidable projections or inserts that may be used in the modular cooler system 100 and which demonstrate both symmetrical and non-symmetrical inserts. Slideable insert 600 as shown as provided in the previous figures and would be considered a symmetrical slideable insert since both side edges are mirror images of one another. Similarly, slideable insert 604 includes rounded sides or edges of a slideable insert and would also be considered a symmetrical slideable insert. Slideable inserts 602 and 606 are shown in FIG. 29 with non-symmetrical edges or sides. In such cases, the non-symmetrical inserts would need or would be required to be inserted into a corresponding receptacle in a manner in which the corresponding profiles directly mate or match.

Figure 30:
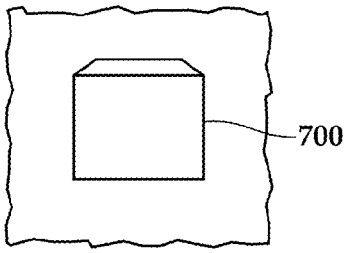
FIG. 30 is one configuration of a slidable insert that may be attached to a wall or structure, such as a structure within the inside of a boat, so that the modular container system may be adequately secured.

FIG. 30 is one configuration of a slideable insert 700 that may be mounted, for example, on a wall, floor or other member, such as a wall on a boat, so that the modular cooler system 100 may be secured through a connection or coupling with a corresponding receptacle of the modular cooler system 100. Of course, the slideable insert and receptacle portions may be reversed in other implementations.

Figure 31:
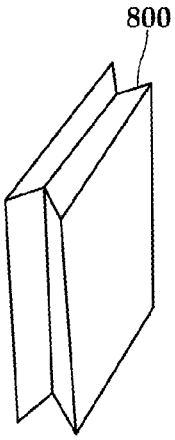
FIG. 31 is one configuration of a slidable insert converter with a slidable insert on each opposing side that may be used to convert a receptacle of, for example, an accessory or insulated compartment, to an insert.

FIG. 31 is a one configuration of a slideable insert converter 800 that includes a slideable insert on a first side and a slideable insert on an opposing side. As can be seen, this slideable insert may be placed within an open receptacle such that the slideable insert on the opposing side of the slideable insert converter 800 would now be available externally to mate with an accessory or other item of the modular cooler system 100. This provides the convenience to allow for more configurations of the accessories to be coupled in more ways.

Figure 32:
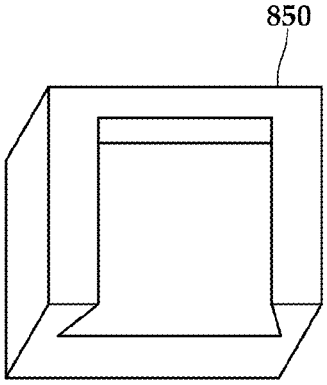
FIG. 32 is one configuration of a receptacle converter with a receptacle on each opposing side, and each receptacle opening from opposite ends of the receptacle converter.

Similarly, FIG. 32 illustrates one configuration of a receptacle converter 850 with a receptacle on each opposing side such that each receptacle opening is provided at opposite ends of the receptacle converter 850. Focusing now on FIG. 32, the open receptacle provided on the other side from the open receptacle that is visible in FIG. 32, would have an opening at a top portion and would extend downwardly therefrom and thus its opening would be on an opposite end from the opening as shown from the receptacle that is visible in FIG. 32. The receptacle converter 850, in operation, may be placed on any open or available slideable insert of the modular cooler system 100 to allow for the conversion of the coupling from an insert to a receptacle. Just as was discussed with FIG. 31, this provides added flexibility to allow for more configurations of the modular cooler system 100.

In certain other implementations, a receptacle converter may be provided that includes a first receptacle side with a receptacle opening at a first end, and a second receptacle side with a receptacle opening at a second end that is opposite the first end. In other embodiments, a converter from a receptacle to a projection (which may also be referred to as an extension), or from a projection or extension to a receptacle, is provided.

Figure 33A:
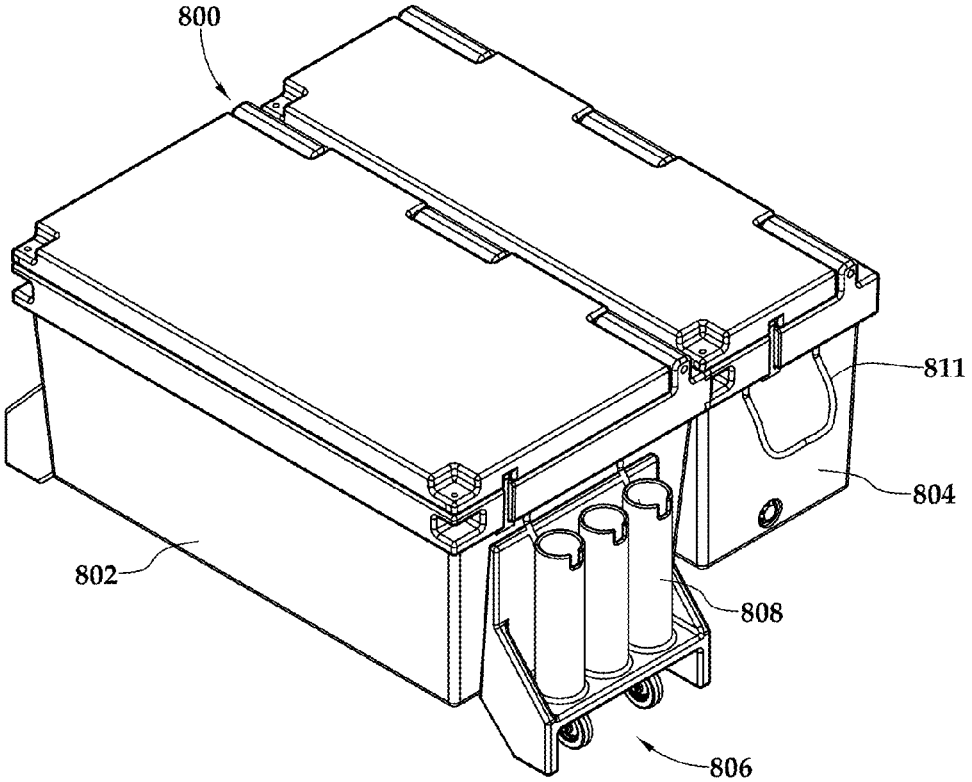
FIGS. 33A-33C illustrate an assembled modular container system according to an embodiment of the present disclosure.
Figure 33B:
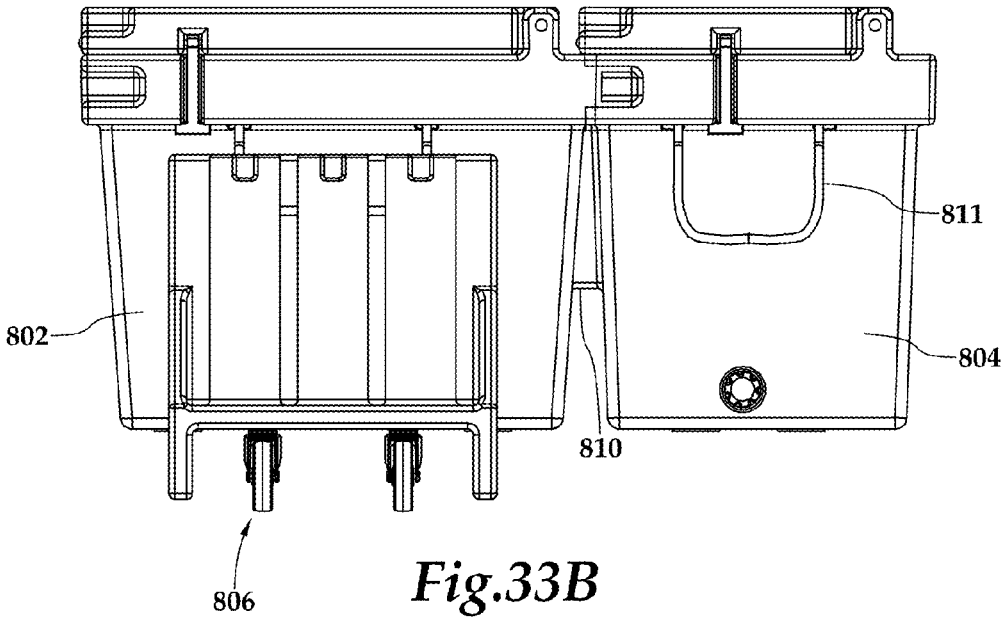
Figure 33C:
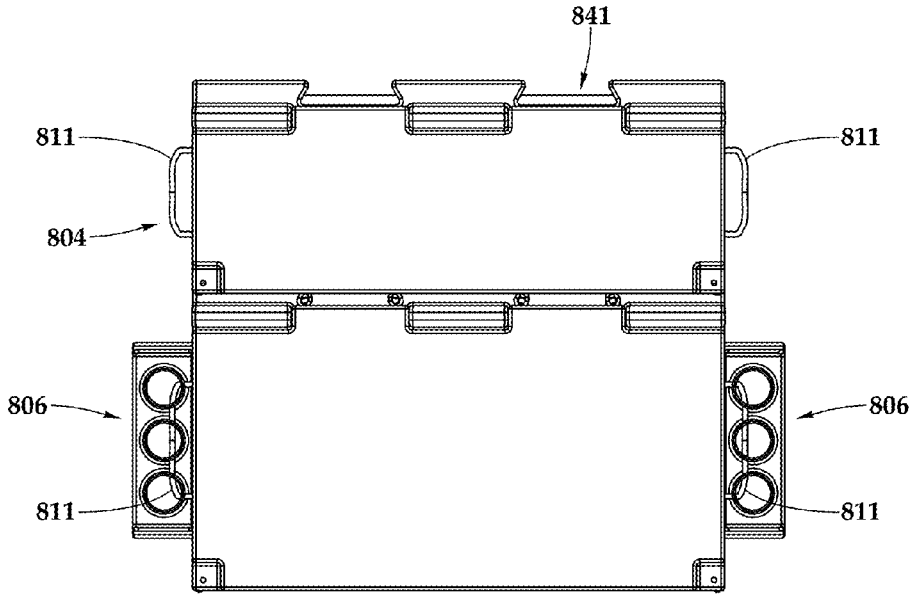

FIGS. 33A-33C illustrate several views of an alternate embodiment of a modular cooler system 800. The modular cooler system 800 includes a wet box 802 coupled to a dry box 804. The interior insulated volume of the wet box 802 may be substantially greater than the interior insulated volume of the dry box 804. For example, the insulated volume of the wet box 802 may be approximately 80 quarts and the insulated volume of the dry box 804 may be approximately 40 quarts. The wet box 802 and the dry box 804 may have any suitable internal volume according to the teaching of the present disclosure.

The dry box 804 is coupled to the wet box 802 through one or more slidable projections or inserts 810 received in a corresponding external receptacle (See FIG. 33B). The modular cooler system 800 also includes a dolly 806 coupled on each side of the wet box 802. According to one embodiment, the dolly 806 includes one or more fishing rod holders 808. The dollies 806 enable level rolling of the modular cooler system 800. The wet box 802 and the dry box 804 may each have a pair of handles 811 coupled to the right and left sides. The handles 811 may be any suitable handle for handling the modular cooler system 800 or component thereof, such as the wet box 802 or the dry box 804. In one embodiment, the handle 811 is a rope handle firmly attached to the dry box 804 and/or the wet box 802.

Figure 34:
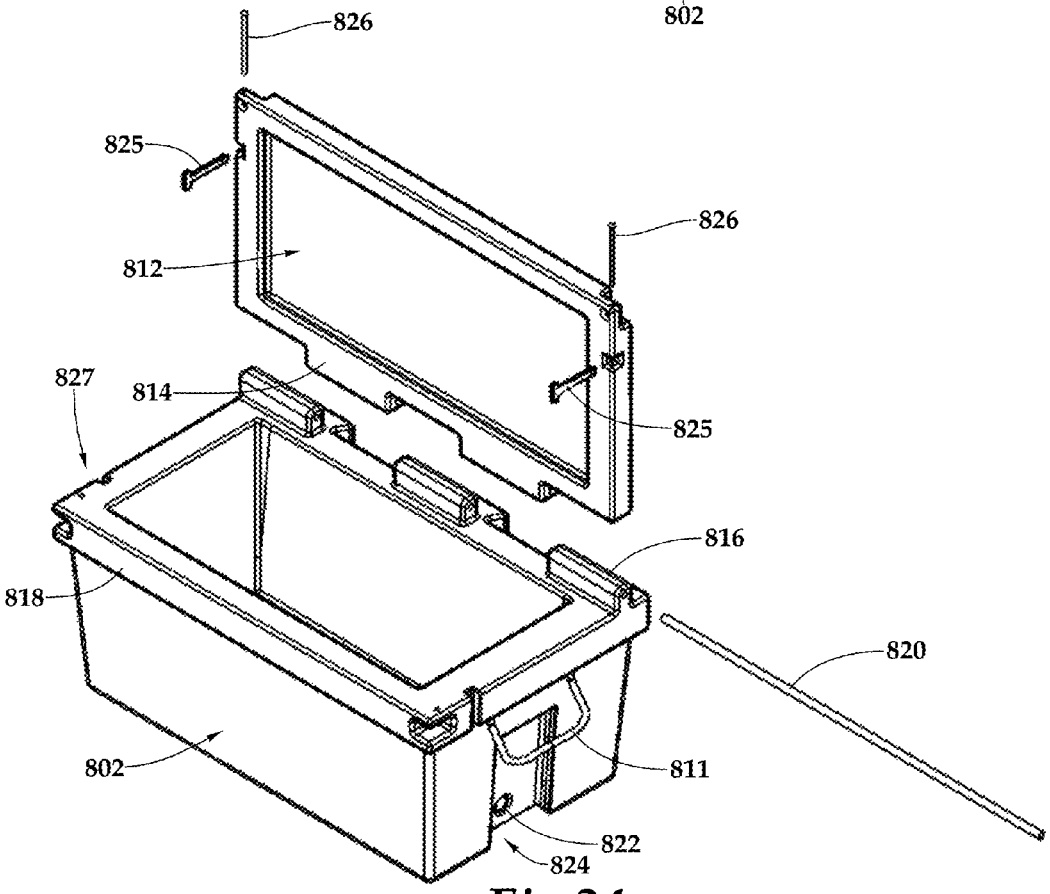
FIG. 34 illustrates an isometric view of a wet box container of the modular container system of FIGS. 33A-33C.

FIG. 34 illustrates an exploded isometric view of the wet box 802 with a cover 812 shown in an exploded orientation. The cover 812 attaches to the wet box 802 through a hinge connection. Specifically, two cover projections 814 extend from a rear of the cover 812 and fit between corresponding compartment projections 816. The compartment projections 816 extend from a top surface of the wet box compartment 802. For example, the compartment projections 816 may extend from a lip 818 that surrounds a perimeter of a top portion of the wet box 802. The lip 818 provides additional structural support for the cover 812.

Each of the compartment projections 816 and the cover projections 814 define a through hole. When the cover 812 is in position between the compartment projections 816, a hinge-rod 820 is received through the through holes in the compartment projections 816 and the cover projections 814 and hingedly secures the cover 812 to the wet box 802. Having the hinged engagement on the top of the wet box 802 extending vertically as opposed to extending horizontally from a rear surface of the wet box 802, clearance for the opening of the cover 812 is provided when the dry box 804 is attached to the wet box 802.

A water plug 822 is disposed in an accessory receptacle 824. The water plug 822 may be removed or opened to allow water or other liquid that may have accumulated in the internal volume of the wet box 802 to be conveniently drained from the wet box 802. The accessory receptacle 824 allows for a dovetail type engagement between the male projection or slidable insert of the dolly 806 and the accessory receptacle 824 of the wet box 802 as shown in FIGS. 33A-C.

The cover 812 is latched to the wet box 802 in a closed position using a pair of the elastomeric T-latches 825. The elastomeric T-latches 825 are secured to the cover 812 through a T-latch pin 826. The elastomeric T-latch 825 may elastically stretch to be received in a corresponding slot 827 of the wet box 802. The resilient material of the elastomeric T-latch 825 can be extended and then allowed to contract to provide a suitable downward force on the cover 812 to keep the cover 812 in a closed position, which keeps the contents of the wet box 802 thermally insulated.

Figure 35A:
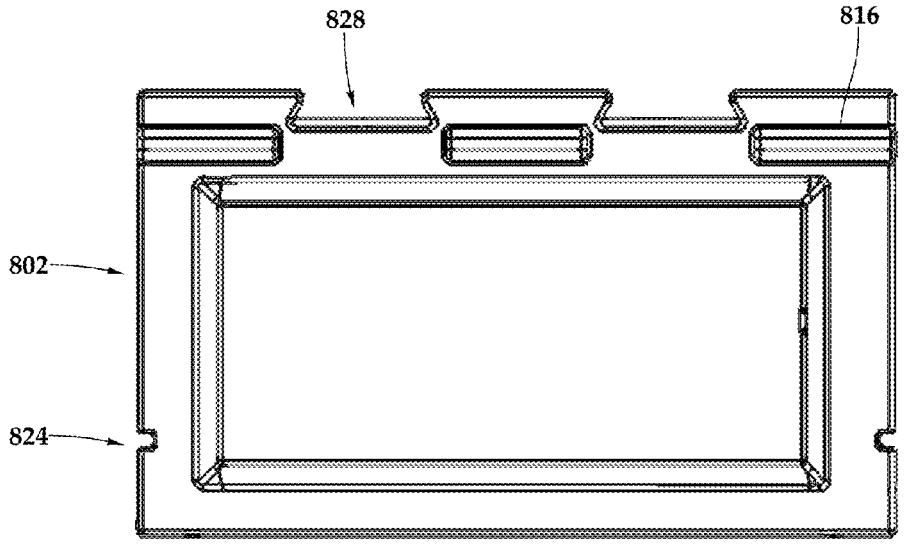
FIGS. 35A-35B illustrate top and bottom views of the wet box shown in FIG. 34.
Figure 35B:
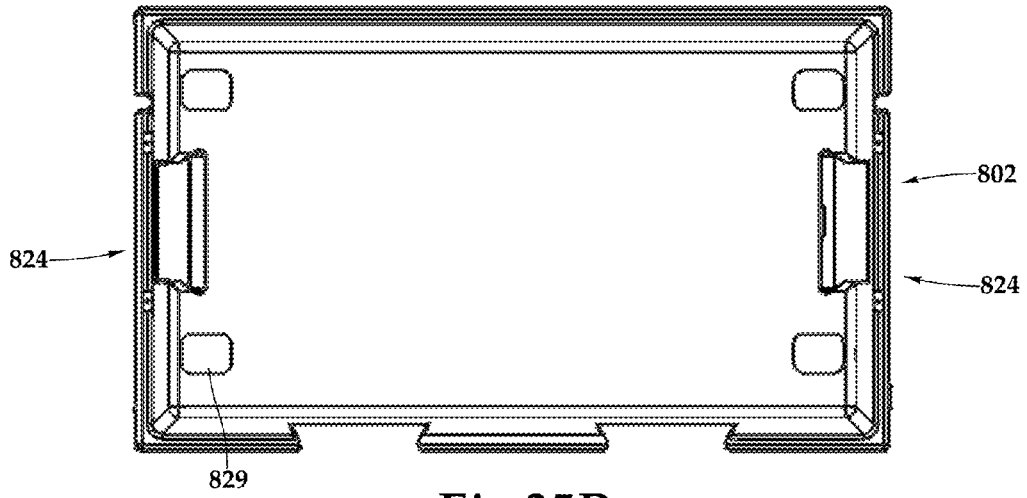

FIGS. 35A and 35B illustrate top and bottom views of the wet box 802. In the top view of FIG. 35A, the relationship between the compartment projection 816 and the external receptacles 828 on a rear surface of the wet box 802 is shown. The external receptacles 828 are configured to receive the slidable insert 810 disposed on a front surface of the dry box 804 to secure the dry box 804 to the wet box 802 with a dovetail type engagement or other sliding engagement such as a tapered projection that is received in a correspondingly tapered receptacle.

FIG. 35B illustrates an underside of the wet box 802. The accessory receptacles 824 are shown in this view. In addition, the underside of the wet box 802 may include one or more anti-skid pads 829. The anti-skid pads 829 may be adhered to the bottom surface of the wet box 802 and may be formed of an elastomeric material that will increase the frictional force required to slide the wet box 802 on a surface.

Figure 36A:
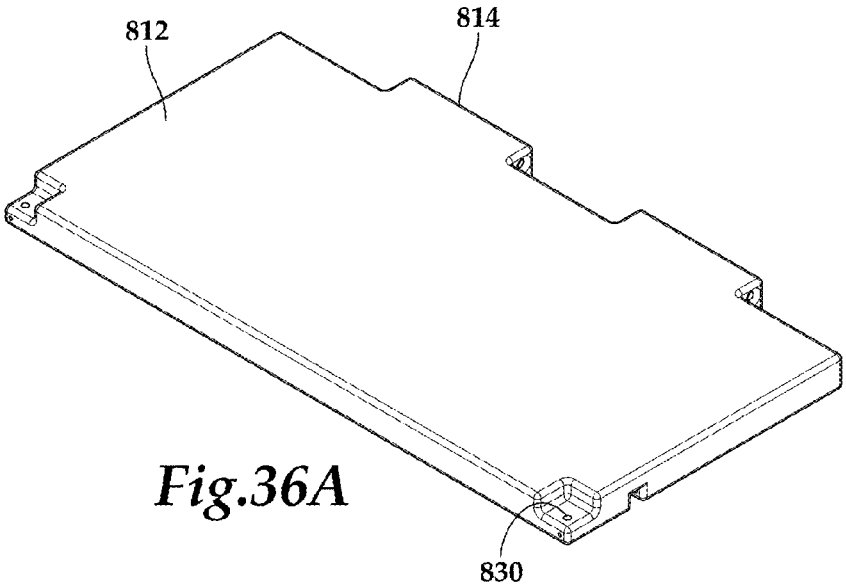
FIGS. 36A-36C illustrate various views of a cover that contains the contents of the wet box container according to the teachings of the present disclosure.
Figure 36B:
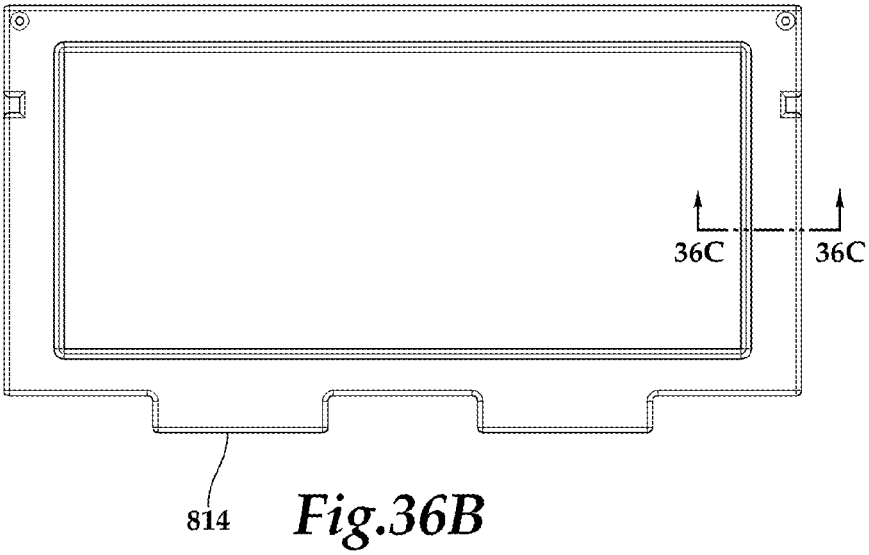
Figure 36C:
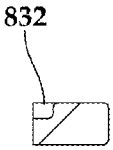

FIG. 36A is an isometric view of the cover 812, and FIG. 36B is a bottom view of the cover 812. As described with respect to FIG. 34, the cover 812 includes a plurality of cover projections 814 extending from a rear surface of the cover 812. The cover 812 also includes a locking hole 830. The locking hole 830 is configured to align with a corresponding locking hole of the wet box 802. In this manner, a padlock or other securing mechanism may be inserted through locking hole 830 on the cover and the corresponding locking hole on the wet box 802 and the cover may be locked in a closed position with respect to the wet box 802. The bottom surface of the cover 812 is configured to receive an elastomeric gasket 832, as shown in the section view, FIG. 36C. The gasket 832 provides a seal around the perimeter of the lip 818 of the wet box 802. The gasket 832 prevents heat from entering the internal volume of the wet box 802 which keeps the contents at a desired cool temperature. The gasket 832 may be made of any suitable elastomeric material used for providing an airtight thermal seal. The features and functionality described with respect to the cover 812 of the wet box 802 also apply to the cover 836 of the dry box 804 (see FIG. 38). The cover may also include a recess in a top surface configured to receive an interchangeable plate with a logo or other indicator.

Figure 37:
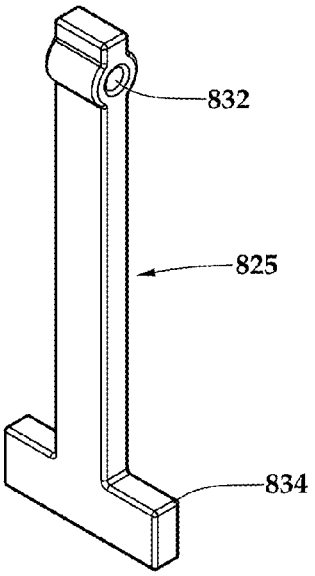
FIG. 37 is an isometric view of an elastomeric T-latch used to secure the cover in a closed position with respect to the wet box.

FIG. 37 is an isometric view of the elastomeric T-latch 825. Through a top portion of the T-latch 825 is a pin-receiving hole 833. The pin-receiving hole 833 receives the T-latch pin 826 to secure the elastomeric T-latch 825 to the cover 812.

The T-shape of the T-latch 825 allows the T-latch to be secured in the corresponding slot 827 of the wet box 802. A horizontal portion 834 of the T-latch 825 provides the downward force on the cover 812 to keep it in a closed position when the T-latch is received in the T-latch slot 827.

Figure 38:
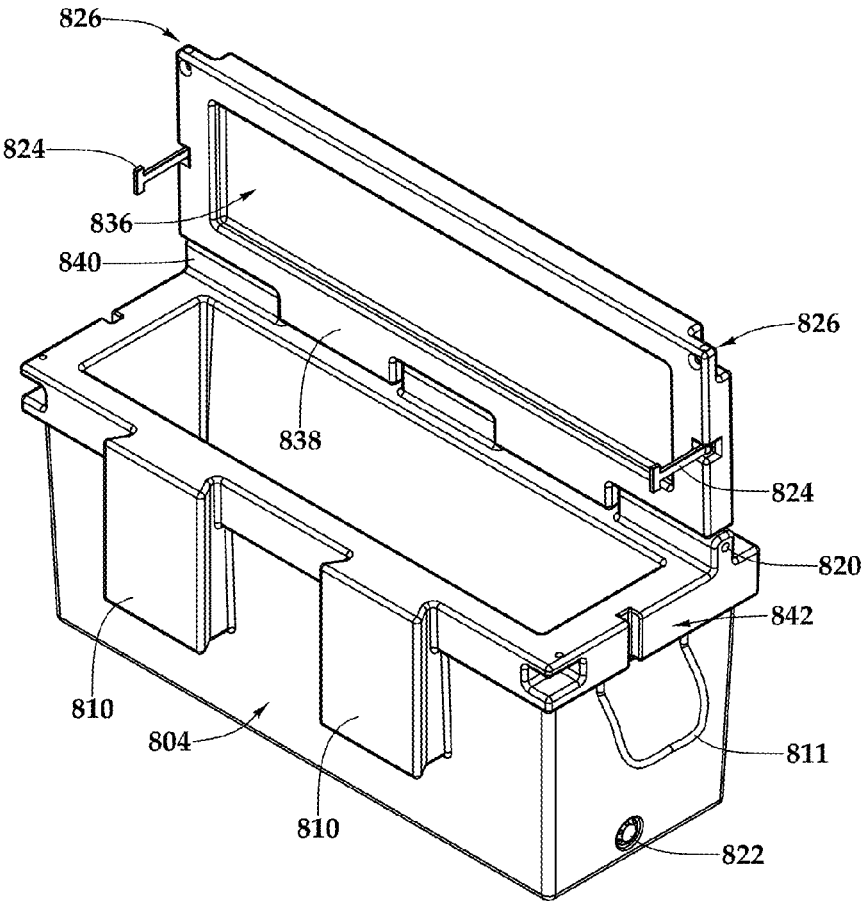
FIG. 38 is an isometric view of the dry box container shown in FIGS. 33A-33C.

FIG. 38 is an isometric view of the dry box 804. The dry box 804 includes many of the same elements described above with respect to the wet box 802. For example, the dry box 804 includes the same hinged engagement of a cover 836 to the dry box 804 through the engagement of cover projections 838 between compartment projections 840 and a hinge rod or pin 820 is received through the compartment projections 840 and the cover projections 838 to secure the cover 836 to the dry box 804. The primary difference between the dry box 804 and the wet box 802 is the slidable inserts 810 disposed on the front of the dry box 804. As previously described with respect to FIG. 33B, the slidable insert 810 is received in an external receptacle 828 of the wet box 802 to secure the dry box 804 to the wet box 802 in sliding engagement providing a friction fit. In addition, the dry box 804 includes a plurality of external receptacles 841 formed in its rear surface (see FIG. 33C). In the embodiment illustrated in FIG. 38, the dry box 804 does not include an accessory receptacle 824. However, in certain embodiments, the dry box 804 may include one or more accessory receptacles 824 similar to the wet box 802.

The dry box 804 includes an elastomeric T-latch 825 that is received in a corresponding slot 842 of the dry box 804. It should be noted, that the T-latch engagement with the dry box 804 is on a side of the dry box 804, as opposed to the front. The side engagement of the T-latch 825 allows for the dry box 804 to be secured to the wet box 802 and still have its cover 836 latched in place where the latch engagement is accessible and not blocked by the wet box 802. The dry box 804 also includes a rope handle 812 disposed on each side of the dry box 804. In certain embodiments, the capacity of the dry box 804 may be approximately half of the capacity of the wet box 802.

Figure 39A:
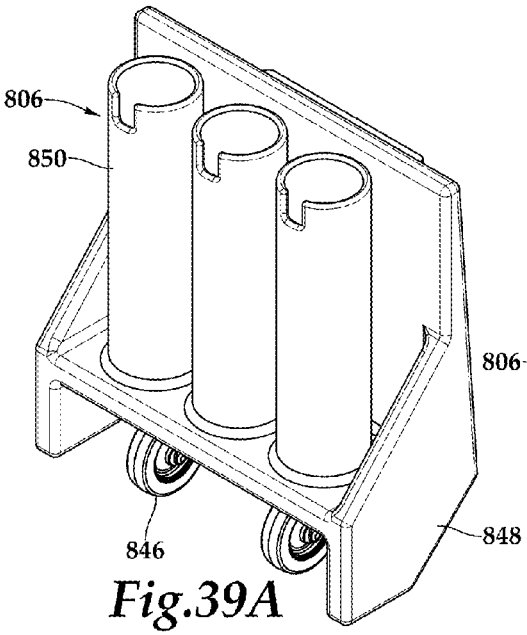
FIGS. 39A-39B illustrate various views of the dolly including fishing rod holders shown in FIGS. 33A-33C.
Figure 39B:
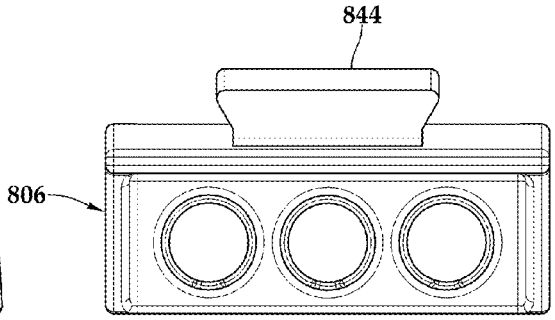

FIG. 39A illustrates an isometric view of the dolly 806, and FIG. 39B is a top view of the dolly 806. As shown in FIGS. 33A-C, the dolly 806 is configured to be coupled to the accessory receptacle 824 on the side of the wet box 802. Similar to the slidable engagement between the wet box 802 and the dry box 804, a slidable accessory insert 844 is disposed proximate a rear surface of the dolly 806 and is received by the accessory receptacle 824 disposed on a side of the wet box 802. When not in position to enable rolling, the dolly 806 may be inverted and the accessory insert 844 may be received in one of the external receptacles 828, 841 of either the wet box 802 or the dry box 804.

The dolly 806 includes one or more castors or wheels 846. The wheels may be mounted such that they are free to rotate 360 degrees to enable level rolling of the modular cooler system 800 or the wet box 802. In addition, only one dolly 806 may be coupled to the wet box 802 to enable rolling of the modular cooler system 800 or the wet box 802 when the opposite side is tipped upward. The castors 846 are protected by a pair of wheel protectors 848 that extend downward from the dolly 806 but provide suitable clearance from the ground to allow free rolling of the wet box 802/dolly 806 assembly. The protectors 848 may also serve to stabilize the wet box 802 in the event the dry box 804 is overloaded and tends to cause the wet box 802 to tip off the castors 846. The dolly 806 also includes three fishing rod holders 850, which are configured to hold a fishing rod in an upright position when inserted in the cylindrical fishing rod holder 850.

Figure 40A:
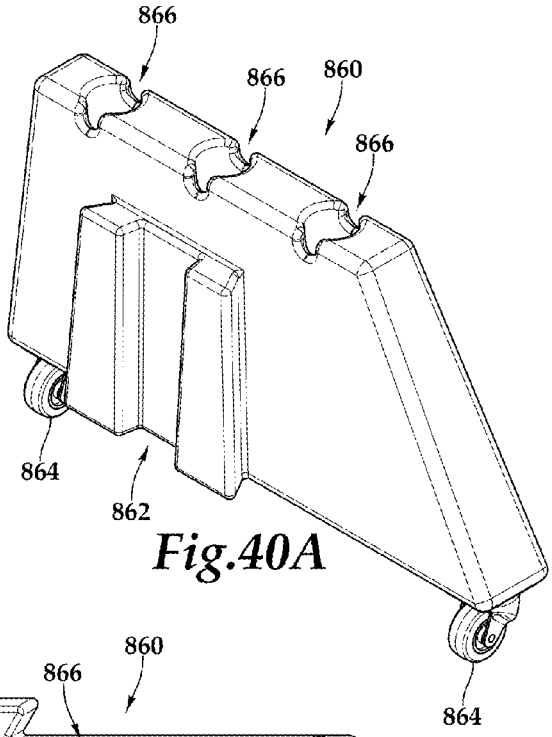
FIGS. 40A-40B illustrate various views of an alternate embodiment of a wheeled-dolly including fishing rod holders.
Figure 40B:
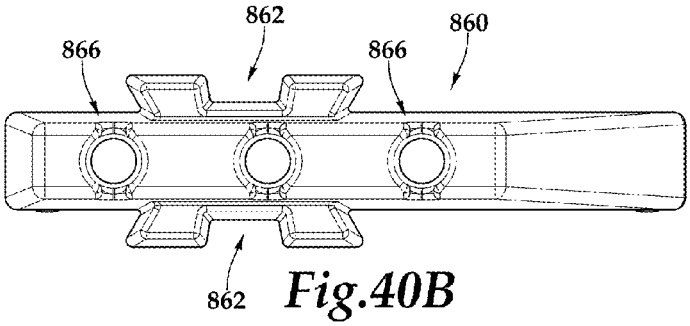

FIG. 40A illustrates an isometric view of an alternate embodiment of a wheeled-dolly 860, and FIG. 40B is a top view of the wheeled-dolly 860. The dolly 860 includes a pair of slidable accessory projections 862, one projection 862 disposed on each side of the dolly 860. The slidable accessory projection 862 is configured to be received by the accessory receptacle 824 on the side of the wet box 802, similar to the dolly 806. However, the slidable accessory projections 862 are tapered from a bottom of the dolly 860 to provide a suitable friction fit. However any suitable means of mechanically joining the dolly 860 and the wet box 802 may be used according to the teachings of the present disclosure. According to one embodiment, one dolly 860 is received by a correspondingly tapered accessory receptacle 824 on the right side of the wet box 802, and one dolly 860 is received by the accessory receptacle 824 on the left side of the wet box. Thus, the modular cooler system 800 may be rolled in a level orientation.

Because a slidable accessory projection 862 is disposed on each side of the dolly 860, the same dolly 860 may be received on either the right or the left side of the wet box 802, even though the dolly 860 is not symmetrical. The placement of the wheels 864 with respect to the slidable accessory projections 862 allows the dolly 860 to support the assembled modular cooler system 800 including the coupled wet box 802 and dry box 804 with a single pair of dollies 860 without tipping.

In addition, the slidable accessory projection of the wheeled-dolly 860 may be inverted and received in one of the external receptacles 828, 841 of either the wet box 802 or the dry box 804. In this manner, the wheeled-dollies 860 may be docked when rolling of the modular cooler system 800 is not desired.

Similar to the dolly 806, the wheeled-dolly 860 includes three fishing rod holders 866. The fishing rod holders 866 are generally three holes in a top portion of the dolly 860 in which an end of a fishing rod may be received such that the fishing rod will stand upright. In the illustrated embodiment, the dolly 860 including the slidable accessory projection 862 and the fishing rod holders 866 is formed as a single integral part using a polymeric molding operation known in the art such as roto-molding.

Alternate embodiments of the dolly 806 and/or the dolly 860 may include cup holders, a seat, a shelf, or other accessories as described above with respect to FIGS. 18-22.

Thus, it is apparent that there has been provided, in accordance with the present invention, a modular cooler system that satisfies one or more of the advantages set forth above. Although the preferred embodiment has been described in detail, it should be understood that various changes, substitutions, and alterations can be made herein without departing from the scope of the present invention, even if all of the advantages and benefits identified above are not present. For example, the various embodiments and examples shown in the drawings and descriptions provided herein illustrate that the present invention may be implemented and embodied in numerous different ways that still fall within the scope of the present invention, whether expressly shown herein or not. For example, the various elements or components may be combined or integrated in another system or certain features may not be implemented. Also, the techniques, systems, and accessories described and illustrated in the preferred embodiment as discrete or separate may be combined or integrated with other systems, designs, techniques, or methods without departing from the scope of the present invention. For example, in one embodiment the dolly 106 may be permanently attached or integrated with the wet box 102, and positioned in a variety of locations, including locations not specifically discussed herein. Other examples of changes, substitutions, and alterations are readily ascertainable by one skilled in the art and could be made without departing from the spirit and scope of the present invention.

What is claimed is:

1. A modular container system comprising:

a container having an internal volume defined at least partially by:

a front portion, a right side portion, having a top end and a bottom end, a left side portion positioned opposite the right side portion, the left side portion having a top end and a bottom end, a back portion positioned opposite the front portion, a bottom portion, and a top cover portion positioned opposite the bottom portion;

a first tapered receptacle integrally molded in an outer surface of the right side portion, wherein the first tapered receptacle comprises oppositely disposed sidewalls extending partially from the bottom end of the right side portion towards the top end of the right side portion, the oppositely disposed sidewalls of the first tapered receptacle partially defining a first tapered dovetail-shaped recess;

a second tapered receptacle integrally molded in an outer surface of the left side portion, wherein the second tapered receptacle comprises oppositely disposed sidewalls extending partially from the bottom end of the left side portion towards the top end of the left side portion, the oppositely disposed sidewalls of the second tapered receptacle partially defining a second tapered dovetail-shaped recess;

a slidable insert having an engaging portion comprising tapered first and second angled walls, the first and second angled walls partially defining opposite sides of a tapered dovetail-shaped projection;

wherein the engaging portion is shaped to slidably insert into the first tapered receptacle to provide at least a partial surface-to-surface contact with the oppositely disposed sidewalls of the first tapered receptacle.

2. The modular container system according to claim 1, wherein the first tapered dovetail shaped recess narrows as it extends from the bottom end of the right side portion towards the top end of the right side portion.

3. The modular container system according to claim 1 and further comprising a second slidable insert having an engaging portion comprising tapered first and second angled walls, the first and second angled walls partially defining opposite sides of a tapered dovetail shaped projection.

4. The modular container system according to claim 3, wherein the engaging portion of the second slidable insert is shaped to slidably insert into the second tapered receptacle to provide at least a partial surface-to-surface contact with the oppositely disposed sidewalls of the second tapered receptacle.

5. The modular container system according to claim 1, wherein the slidable insert is configured to be mounted to a surface.

6. The modular container system according to claim 5, wherein the surface-to-surface contact between the engaging portion and the oppositely disposed sidewalls of the first tapered receptacle secures the container relative to the surface.

7. The modular container system according to claim 1, wherein the first tapered receptacle further includes a stop provided at an intermediate location between the top end and the bottom end of the outer surface of the right side portion.

8. A modular container system comprising:

a container having:

a top portion, a bottom portion opposing the top portion, the bottom portion comprising an outer surface, and a latch configured for maintaining a closed position between the top and bottom portions of the container, wherein when in the closed position, the top and bottom portions enclose an interior chamber for storing contents;

a first tapered receptacle integrally molded in the outer surface of the bottom portion, wherein the first tapered receptacle comprises oppositely disposed sidewalls extending partially from a bottom edge of the bottom portion towards a top edge of the bottom portion, the oppositely disposed sidewalls of the first tapered receptacle partially defining a first tapered dovetail shaped recess;

a second tapered receptacle integrally molded in the outer surface of the bottom portion, wherein the second tapered receptacle comprises oppositely disposed sidewalls extending partially from the bottom edge of the bottom portion towards the top edge of the bottom portion, the oppositely disposed sidewalls of the second tapered receptacle partially defining a second tapered dovetail shaped recess;

a slidable insert having an engaging portion comprising tapered first and second angled walls, the first and second angled walls partially defining opposite sides of a tapered dovetail shaped projection;

wherein the engaging portion is shaped to slidably insert into the first tapered receptacle to provide at least a partial surface-to-surface contact with the oppositely disposed sidewalls of the first tapered receptacle.

9. The modular container system according to claim 8, wherein the first tapered dovetail shaped recess narrows as it extends from the bottom edge towards the top edge.

10. The modular container system according to claim 8 and further comprising a second slidable insert having an engaging portion comprising tapered first and second angled walls, the first and second angled walls partially defining opposite sides of a tapered dovetail shaped projection.

11. The modular container system according to claim 10, wherein the engaging portion of the second slidable insert is shaped to slidably insert into the second tapered receptacle to provide at least a partial surface-to-surface contact with the oppositely disposed sidewalls of the second tapered receptacle.

12. The modular container system according to claim 8, wherein the slidable insert is configured to be mounted to a surface.

13. The modular container system according to claim 12, wherein the surface-to-surface contact between the engaging portion and the oppositely disposed sidewalls of the first tapered receptacle secures the container relative to the surface.

14. The modular container system according to claim 8, wherein the first tapered receptacle further includes a stop provided at an intermediate location between the top edge and the bottom edge.

15. A method of securing a modular container to a surface, the method comprising:

providing a container that includes:

a front portion, a right side portion, a back portion, a left side portion, a bottom portion, a top cover portion pivotally coupled to the back portion, and a first tapered receptacle integrally molded in an outer surface of the right side portion, wherein the first tapered receptacle comprises oppositely disposed sidewalls extending partially from a bottom end of the right side portion towards a top end of the right side portion, the oppositely disposed sidewalls of the first tapered receptacle partially defining a first tapered dovetail shaped recess;

providing a slidable insert configured to be mounted to a surface, the slidable insert having an engaging portion comprising tapered first and second angled walls, the first and second angled walls partially defining opposite sides of a tapered dovetail shaped projection; and frictionally engaging the first tapered receptacle with the engaging portion of the slidable insert to secure the container to the slidable insert.

16. The method of claim 15 and further comprising:

mounting the slidable insert to the surface.

17. The method according to claim 15, wherein the container comprises a second tapered receptacle integrally molded in an outer surface of the left side portion, wherein the second tapered receptacle comprises oppositely disposed sidewalls extending partially from a bottom end of the left side portion towards a top end of the left side portion, the oppositely disposed sidewalls of the second tapered receptacle partially defining a second tapered dovetail shaped recess.

18. The method according to claim 15, wherein frictionally engaging the first tapered receptacle with the engaging portion of the slidable insert to secure the container to the slidable insert further includes sliding the slidable insert into an opening in the bottom end of the right side portion.

19. The method according to claim 15, wherein the first tapered receptacle further includes a stop provided at an intermediate location between the top end and the bottom end of the outer surface of the right side portion.

* * * * *